United States Patent [19]

Knecht

[11] 4,422,004

[45] Dec. 20, 1983

[54] TRANSVERSE ARC TUBE MOUNTING

[75] Inventor: David C. Knecht, Columbus, Ohio

[73] Assignee: General Electric Company, Schenectady, N.Y.

[21] Appl. No.: 276,878

[22] Filed: Jun. 24, 1981

[51] Int. Cl.[3] ..... H01J 61/30

[52] U.S. Cl. ..... 313/25

[58] Field of Search ..... 313/25

[56] References Cited

U.S. PATENT DOCUMENTS

| | | | |
|---|---|---|---|
| 2,901,648 | 8/1959 | Lindsay et al. | 313/25 |
| 2,904,710 | 9/1959 | Beeninga et al. | 313/25 |
| 4,142,122 | 2/1979 | Koza | 313/25 |
| 4,341,975 | 7/1982 | Phillipp et al. | 313/25 |

*Primary Examiner*—Palmer C. Demeo

*Attorney, Agent, or Firm*—John P. McMahon; Philip L. Schlamp; Fred Jacob

[57] ABSTRACT

Transverse mounting of an arc tube with a pivoting attachment to a support rod extending through a lamp jacket is effected by a hinge plate comprising a metal ribbon folded back on itself and encircling a hinge pin. The hinge plate is welded to the support rod, and the hinge pin together with a wrap-around metal band clamps the pinched upper end of the arc tube. A two-piece connector having a bendable joint serves in lieu of a latch and assures accurate orientation of the arc tube after it has been transversely erected within the jacket.

5 Claims, 2 Drawing Figures

TRANSVERSE ARC TUBE MOUNTING

The invention relates to a high intensity discharge lamp comprising an arc tube transversely mounted in an oute evelope or glass jacket, and is especially concerned with the mounting arrangement.

BACKGROUND OF THE INVENTION

The invention is particularly useful with metal halide arc discharge lamps used for general illumination which comprise an arc tube of quartz having elecrodes at each end and containing a fill of mercury, metal halide and an inert gas for starting purposes, and an enclosing outer envelope or jacket made of glass. The jacket is either evacuated or filled with an inactive gas and generally comprises a bulbous or ellipsoidal main portion which is extended at one end into a tubular neck portion to which is attached a screw type base for accommodating the lamp in a standard socket. The common practice has been to mount the arc tube axially within the jacket and to operate the lamp vertically.

Vertical operation of the arc tube is the preferred mode resulting in higher efficacy and longer life. If the arc tube is inclined out of the vertical, internal convection currents affect the discharge and displace it from the axis, causing overheating in some parts and underheating in others, and the end result is lower efficacy and poorer color rendition. However there are many installations wherein considerations of space and convenience require that the outer envelope of the lamp be mounted horizontally. In recent years, primarily as a result of improvements in color rendition, metal halide lamps have found increasing use indoors and in applications where the ceiling height is limited. Fixtures for such applications mount the outer envelope horizontally in order to save space. This has increased the demand for metal halide lamps able to operate without reduction in efficacy or life when the outer envelope is horizontal.

Mounting the arc tube transversely to the axis of the jacket is difficult because the arc tube is longer than the diameter of the neck. One transverse mounting arrangement is described and claimed in copending application Ser. No. 271,505, filed June 8, 1981, by Paul W. Ernest and assigned to the same assignee as the present invention. It features a hinged attachment of the arc tube to a single long support rod extending the length of the jacket and curving in proximity to the wall and serving also as electrical connector to one electrode. During manufacture the hinges permit the arc tube to be folded substantially in line with the support rod for passage through the neck, and then allow the arc tube to be transversely erected in the bulb and a latch holds the arc tube in its transverse attitude after erection.

SUMMARY OF THE INVENTION

The object of the invention is to provide an improved transverse mounting of the arc tube in a jacketed high intensity discharge lamp whereby the arc tube may be vertical when the lamp is supported horizontally. A mounting arrangement is sought which requires fewer parts and is cheaper to make than any presently available, which requires no special skill in assembling the lamp, and which provides a more accurate orientation and reliable latching after transverse erection.

In a transverse mounting embodying my invention, I have improved the hinged attachment of the Ernest mounting by fastening a hinge plate directly to the long curving support rod in a manner to support a hinge pin transversely beneath it. The hinge pin serves as one side of a clamp which, together with a metal band or strap wrapped tightly around the other side, grips the upper pinched end of the quartz arc tube. In a preferred embodiment the hinge plate is made of thin sheet metal folded back on itself with a wrap around the hinge pin. The arc tube is locked in place relative to the hinge clamp by small embossments raised in the quartz of the pinch. A two-piece connector having a bendable joint serves in lieu of a latch and assures accurate orientation of the arc tube after it has been transversely erected within the jacket.

DETAILED DESCRIPTION

Figures 1, 2:
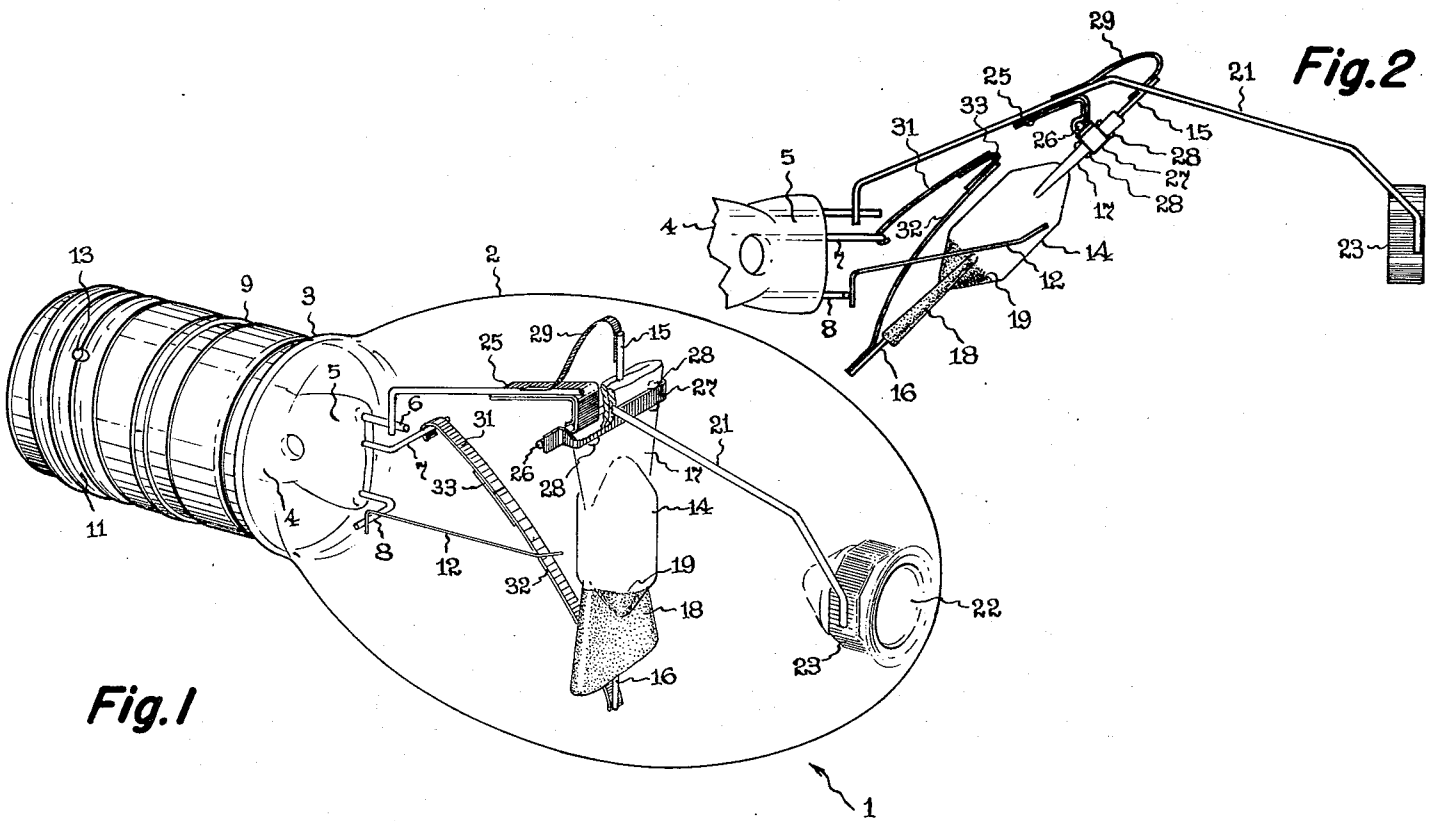
FIG. 1 illustrates a complete jacketed metal halide lamp with transversely mounted arc tube embodying the invention.
FIG. 2 shows the mount with the arc tube swung back for passage through the neck.

Referring to FIG. 1, lamp 1 illustrated therein comprises an outer envelope or jacket of glass comprising a bulb portion 2 and a reduced diameter tubular neck portion 3. In the end of the neck is sealed a re-entrant stem 4 having a press 5 through which extend stiff lead-in wires 6, 7 and 8. To the outer end of the neck is fastened a cylindrical metal shell or collar extender 9 to which is attached a conventional screw base 11. The collar extender allows the base to run at a cooler temperature and permits an electronic starting pulse generator to be located within the base. The pulses are coupled to the arc tube through lead-in wire 8 to which a capacitive probe 12 extending into proximity to the arc tube is attached. Inleads 6 and 7 are connected respectively to the threaded shell and center contact (not shown) of the base 11. A locating pin 13 may be provided on the base shell which strikes a stop in the socket in which the lamp is accommodated after the base has been screwed in almost home. This prevents further rotation of the lamp so that a uniform orientation is achieved in all such sockets.

Arc tube 14 is made of quartz or fused silica and contains mercury, metal halides such as NaI, $ScI_3$ and $ThI_4$ and an inert gas such as argon at a low pressure to facilitate starting. The arc discharge takes place between main electrodes (not shown) supported in opposite ends of the arc tube by inleads 15, 16 which include foliated portions hermetically sealed through conventional wide pinch seals 17, 18. The near corner of the upper pinch has been cut away in FIG. 1 in order to show the hinge. A white heat-reflecting coating 19 may be provided on the lower end of the vertically supported arc tube to make the two ends more nearly equal in temperature notwithstanding convection effects within the arc tube.

In the illustrated embodiment of the invention arc tube 14 is transversely supported in bulbous portion 2 of the jacket through a mount comprising a single support rod 21 welded to stem lead-in wire 6. Rod 21 curves and extends in proximity to the upper wall of the bulb portion all the way to an anchoring dimple 22 at the dome end which it engages by an encircling clip 23. The arc tube is suspended by its upper end approximately below the mid-point of rod 21 by means of a hinged attachment comprising a hinge plate 25 welded to the underside of the rod. The hinge consists of sheet metal strapping wide enough to achieve lateral stability in the hinge restricting the swing of the arc tube substantially to a vertical plane passing through rod 21 (for the lamp attitude illustrated in FIG. 1). The strapping, preferably consisting of nickel-plated ribbon, is folded back on itself and encircles a hinge pin 26 which, together with a metal band 27 forms a clamp gripping the upper pinched end of the arc tube. The metal band is wrapped tightly around the side of the pinch opposite from the hinge pin and is spot-welded at both ends to the hinge pin to form the clamp. The arc tube is locked in place relative to the hinge clamp by reason of small embossments 28 raised in the quartz on both sides of band 27. These embossments are conveniently formed when the quartz is heated to plasticity for sealing in the foliated inleads by pinching the quartz tube ends.

Support rod 21 serves as a current conductor from lead-in wire 6. The upper electrode inlead 15 is electrically connected to rod 21 by a flexible conductor 29 welded to the inlead at one end and to the rod at the other with enough intervening slack to allow the arc tube to be swung back, as shown in FIG. 2, for passage of the mount assembly through the neck of the jacket.

Electrical connection to the lower electrode inlead 16 is made through a two-segment connector 31, 32 having a bendable join 33 uniting the two parts. The segments 31 and 32 may consist of nickel-plated iron ribbons, and the bendable joint may be a small piece of nickel ribbon welded to the segments to form a hinge. The shorter segment 31 is welded to the laterally turned end of lead-in wire 7 after partly encircling it for greater flexibility, while the longer segment 32 is welded to inlead 16. The stiffness of the members is such that bending occurs primarily in the joint 33 and to a lesser extent next to the lead-in wire 7. The arrangement allows the arc tube to be swung back as shown in FIG. 2 with the segmented connector 31, 32 folded upwards like a knee joint. As illustrated in FIG. 1, lead-in wire 7 to which conductor 31, 32 is attached is turned to the far side (relative to the plane of the paper), while lead-in wire 8 to which capacitive probe 12 is attached is turned in the opposite direction to the near side. Folded conductor 31, 32 is thus displaced to the far side while probe 12 is displaced to the near side when the arc tube is swung back as shown in FIG. 2, and interference between the arc tube and the mount parts is avoided. After the mount assembly has been inserted into the jacket, the arc tube is pushed upwards into the desired transverse position. A wand with a hooked end may be used to pull down on bending joint 33 and straighten out segmented connector 31, 32: this readily restores connector 31, 32 to its original design length. The arc tube is thus permanently and accurately locked in transverse orientation to the longitudinal axis of the lamp.

The mount structure of my invention has a particular advantage for metal halide lamps. The arc tube filling of such lamps usually includes sodium iodide, and the sodium $Na^+$ ion can migrate through hot quartz, as is well known. Sodium loss from an arc tube has deleterious consequences, and it is encouraged by metal conductors which can emit photoelectrons when irradiated by ultraviolet and which extend along the arc tube close to its walls. My construction provides no such conductors close to the arc tube so that sodium loss from the quartz arc tube is not a problem.

The preferred embodiment of the invention and the way in which it is assembled have been described for illustrative purposes and the scope of the invention is to be limited only by the following claims.

What I claim as new and desire to secure by Letters Patent of the United States is:

1. An electric lamp comprising:

an outer envelope having a bulb portion with a reduced diameter neck portion having lead-in wires sealed therethrough, a base fastened to the neck portion, an arc tube within the bulb portion of greater overall length than the internal diameter of the neck portion, said arc tube having electrodes attached to inleads sealed into opposite ends, and a mount structure comprising a support rod extending from one of said lead-in wires into the bulb portion and a hinged attachment of one end of said arc tube to said rod allowing the arc tube to be swung out of the way for passage through the neck and thereafter to be swung transversely within the bulb, and means for locking said arc tube in transverse orientation comprising a two-piece connector having a bendable knee joint extending from a lead-in wire in said stem to the inlead in said arc tube opposite its hinged end.

2. A lamp as in claim 1 wherein the lead-in wires sealed through the neck include one turned laterally to one side to which the knee-joint connector is attached to allow the arc tube to be swung out of the way and the knee-joint connector folded without interference.

3. A lamp as in claim 1 wherein the lead-in wires sealed through the neck include one turned to one side to which the knee joint connector is attached, and another turned to the opposite side to which a capacitive probe extending close to the side of the arc tube is attached whereby the arc tube can be swung out of the way by folding said knee-joint connector without interfering with mount parts.

4. A lamp as in claim 1 of the metal halide type wherein the arc tube is made of quartz and the filling includes sodium iodide.

5. A lamp comprising:

a glass jacket having a bulb portion with a reduced diameter neck portion closed by a stem having lead-in wires sealed therethrough, a base fastened to the end of said neck and having contact members, an arc tube within the bulb portion of greater overall length than the internal diameter of the neck portion, said arc tube having electrodes attached to inleads sealed into opposite ends of the tube, and a mount structure comprising a support rod extending from one of said lead-in wires into the bulb portion and a pivoting attachment of said arc tube thereto comprising a hinge plate fastened to said rod and supporting a hinge pin transversely beneath it, said hinge pin together with a metal strap wrapped tightly around the end of the arc tube forming a clamp gripping the arc tube and allowing it to be swung out of the way for passage through the neck and thereafter to be swung into transverse orientation within the bulb, and means for locking said arc tube in transverse orientation comprising a two-piece connector having a bendable joint and extending from one of said lead-in wires in said stem to the inlead in said arc tube opposite its hinged end.

* * * * *